United States Patent [19]

Turbon

[11] Patent Number: 4,521,125

[45] Date of Patent: Jun. 4, 1985

[54] RIBBON CASSETTE ASSEMBLY

[75] Inventor: Klaus Turbon, Wuppertal, Fed. Rep. of Germany

[73] Assignee: Turbon Plastics, U.S.A., Inc., Denville, N.J.

[21] Appl. No.: 573,370

[22] Filed: Jan. 24, 1984

Related U.S. Application Data

[63] Continuation-in-part of Ser. No. 488,190, Apr. 25, 1983.

[51] Int. Cl.[3] ..... B41J 35/28

[52] U.S. Cl. ..... 400/208; 400/234

[58] Field of Search ..... 400/234, 207, 208, 208.1; 242/75.4, 75.43, 198, 197

[56] References Cited

U.S. PATENT DOCUMENTS

| | | | |
|---|---|---|---|
| 4,272,201 | 6/1981 | Steger | 400/208 |
| 4,347,008 | 8/1982 | Jagodzinski et al. | 400/234 X |
| 4,350,453 | 9/1982 | Field et al. | 400/208 |
| 4,350,454 | 9/1982 | Schoenlein | 400/234 |
| 4,373,824 | 2/1983 | Olsen | 400/234 |
| 4,388,006 | 6/1983 | Waibel | 400/208 X |

*Primary Examiner*—Edgar S. Burr
*Assistant Examiner*—Charles A. Pearson
*Attorney, Agent, or Firm*—Louis E. Marn

[57] ABSTRACT

There is disclosed a braking assembly for a ribbon supply spool including an inked ribbon and formed of a planar V-shaped plastic device disposed on a shaft member receiving the ribbon supply spool and comprised of a ring-shaped portion including a tooth member and extend leg portions wherein one leg portion is formed with pin member for coursing the ribbon and wherein a portion of the ring-shaped portion opposite the leg portions is formed of reduced cross-sectional area and wherein the tooth member cooperates with a serrated surface. In a preferred embodiment, the area of reduced cross-section is disposed in a line bisecting an angle formed by the extended leg portions.

3 Claims, 10 Drawing Figures

RIBBON CASSETTE ASSEMBLY

This is a continuation-in-part of U.S. application Ser. No. 488,190, filed Apr. 25, 1983.

FIELD OF THE INVENTION

This invention relates to ink ribbon cassette assembly for typewriters and typing mechanisms for computer, bookkeeping machines and the like, and more particularly to a braking device for an ink ribbon cassette assembly.

BACKGROUND OF THE INVENTION

In use, an ink ribbon of an ink ribbon cassette is subjected to sequential interrupted movement during the starting of the letter or symbol carrying part of the machine as well as by the ribbon drive assembly. To ensure that the ink ribbon is guided at a uniform height portion in front of the letter or symbol carrying part, attention has been directed to the rotation of the ribbon feed shaft.

In U.S. Pat. No. 4,034,935, there is disclosed the use of a layer or strip of foam material disposed proximate the ribbon feed coil or support plate therefor in a manner to engage the ribbon feed coil or support plate of the assembled ink ribbon cassette to thereby retard the rotational movement of the ribbon feed coil during use. While the use of foam material is effective in retarding rotational movement, the placement and/or thickness of the foam material results in uneven forces. Aging of the foam material may also effect uniform operation.

In German application DE-GM No. 80 02 752, there is disclosed the use of a rubber band guided around an extension or shoulder on the shaft of the feed ribbon coil and a cooperating stationary pin or projection. Another solution is the use of a metallic V-shaped coil spring including an upright pin portion positioned on the shaft of the feed ribbon coil wherein the ribbon is coursed about the upright pin of the metallic coil. The metallic material forming the coil spring is subject to many variable factors during manufacturing thereby resulting in uneven force during use.

In the aforementioned copending application, there is disclosed a braking device for a ribbon supply spool and formed of a planar V-shaped plastic device disposed on a shaft of the ribbon supply spool and comprised of a ring-shaped portion from which extend leg portions wherein one leg portion is formed with an upright pin and wherein a portion of the ring-shaped portion opposite the leg portions is formed of reduced cross-sectional area, preferably in a line bisecting an angle formed by the leg portions.

OBJECT OF THE PRESENT INVENTION

An object of the present invention is to provide an improved braking device for an ink ribbon cassette.

Another object of the present invention is to provide an improved braking device for an ink ribbon cassette permitting of more uniform braking force to ribbon feed of the ink ribbon cassette.

A further object of the present invention is to provide an improved braking device for an ink ribbon cassette of facile manufacturing.

Yet another object of the present invention is to provide an improved braking device for an ink ribbon cassette of reduced spacial requirements.

SUMMARY OF THE INVENTION

These and other objects of the present invention are achieved by a braking assembly for a ribbon supply spool including an inked ribbon and formed of a planar V-shaped plastic device disposed on a shaft member receiving the ribbon supply spool and comprised of a ring-shaped portion including a tooth member from which extend leg portions wherein one leg portion is formed with pin member for coursing the ribbon and wherein a portion of the ring-shaped portion opposite the leg portions is formed of reduced cross-sectional area and wherein the tooth member cooperates with a serrated surface. In a preferred embodiment, the area of reduced cross-section is disposed in a line bisecting an angle formed by the extended leg portions.

BRIEF DESCRIPTION OF THE DRAWINGS

A better understanding of the present invention as well as additional objects and advantages thereof will become apparent upon consideration of the detailed description thereof when taken with the accompanying drawing, wherein like numerals designate like parts throughout, and wherein.

DETAILED DESCRIPTION OF THE INVENTION

Figure 1:
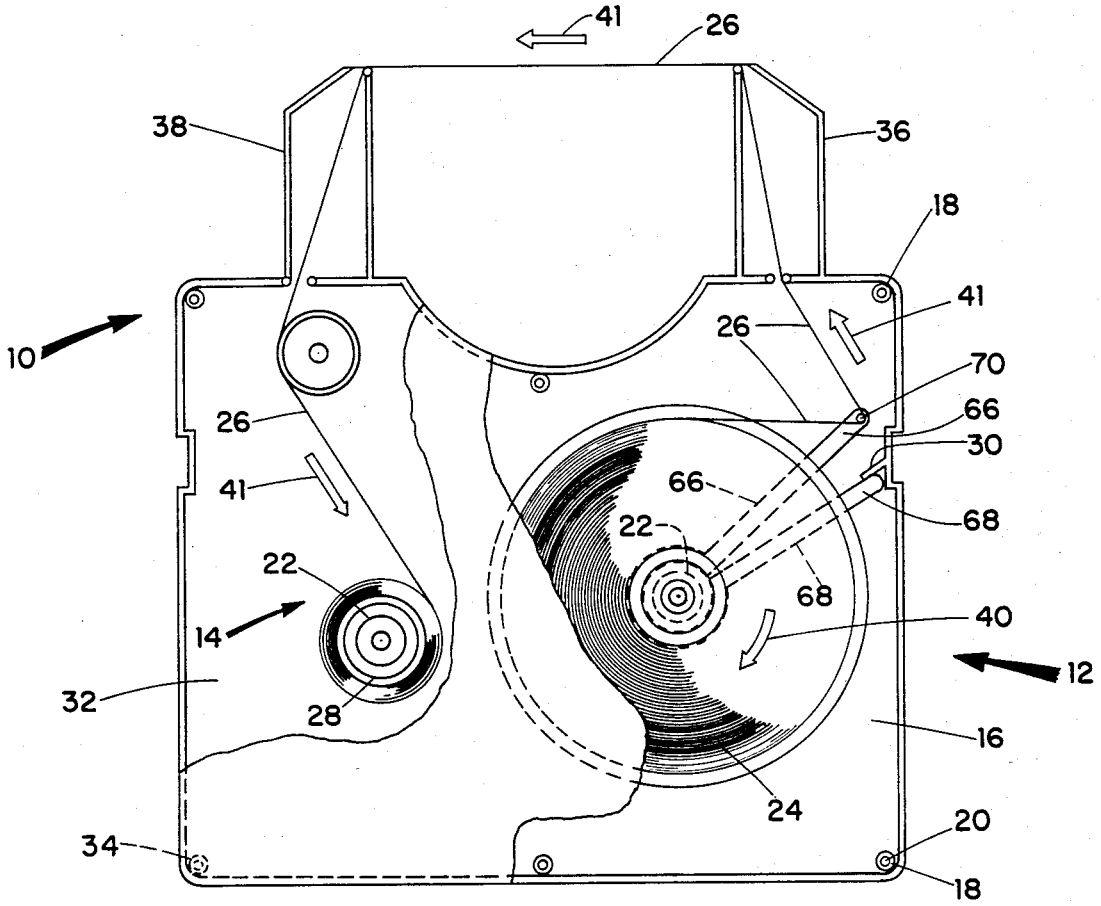
FIG. 1 is a plan view, partially cut away, of a ribbon cassette illustrating the environment of the present invention.

Referring now to the FIG. 1, there is illustrated a ribbon cassette assembly, generally indicated as 10, comprised of a base member and a cover member, generally indicated as 12 and 14, respectively essentially enclosing the ribbon cassette assembly 10, except for certain openings, as more fully hereinafter discussed and as disclosed in the aforementioned in copending application.

The base member 12 is formed of a bottom wall 16 having a plurality of peripherally-disposed eyelet members 18 including orifices 20 and with spaced-apart cylindrically-shaped upright shaft members 22 formed on and extending upwardly from the bottom wall 16 for receiving a ribbon supply spool 24 including ribbon 26 and a take-up ribbon spool 28. The base member 12 is formed with a retaining leg element 30, as more fully hereinafter discussed.

The cover member 14 is similarly-shaped with respect to the base member 12 and is formed by a top wall 32 having a plurality of peripherally-disposed pin members 34 for positioning within the orifices 20 of the eyelets 18 of the base member 12 in an interlocking relationship thereby forming the ribbon cassette assembly 10. Assembly of the cover member 14 with the base member 12 forming the ribbon cassette assembly 10 forms a course for the ribbon 26 from the ribbon supply spool 24 to the ribbon take-up spool 28 via a ribbon exit arm 36 and a ribbon entry arm 38.

The ribbon take-up spool 28 is driven by a drive shaft means (not shown) in a clockwise direction to cause the ribbon 26 to be unrolled from the ribbon supply spool 24; as indicated by the arrow 40 via the ribbon exit arm 36 across an open space and thence through the ribbon entry arm 38 to be taken up on the ribbon take-up spool 28. The ribbon is caused to be moved in the direction indicated by the arrows 41 to permit sequential positioning of ribbon portions before letter and symbol carrying parts of the respective machine (not shown).

Figure 4:
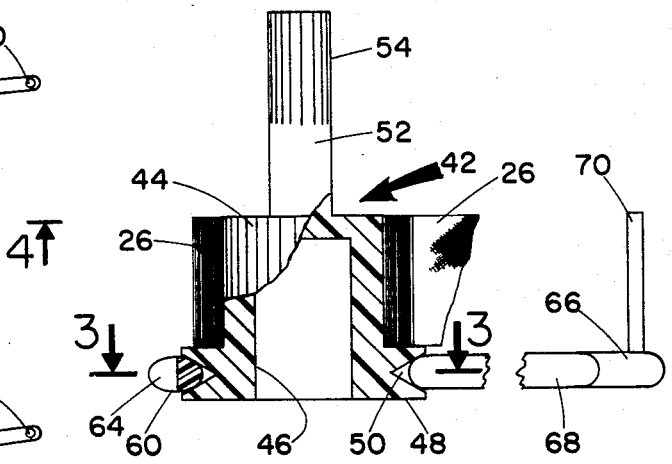
FIG. 4 is a partial cross-sectional side view of the feed spool and braking device-FIGS. 1 to 4 illustrating the invention disclosed in the aforementioned copending application.

The ribbon supply spool 24 is comprised of a shaft member, generally indicated as 42, and the ribbon 26. The shaft member 42, referring particularly to FIG. 4 is comprised of a cylindrically-shaped base portion 44 including a cylindrically-shaped orifice 46 for positioning on shaft 22, a lower ring-shaped portion 48 including a groove 50 and an upper pin portion 52. The lower ring-shaped portion 48 is of a diameter larger than the cylindrically-shaped base portion 44 on which is wound the ribbon 26. The pin portion 52 includes an upper knurled section 54 to aid in initial tensioning of the ribbon 26 within the ribbon cassette 10.

Figure 2:
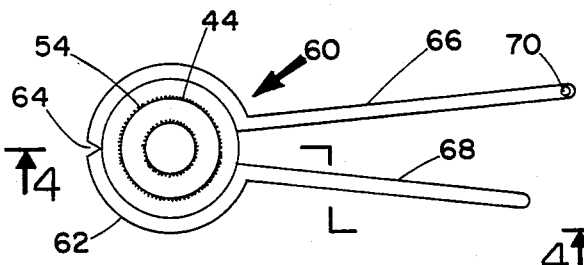
FIG. 2 is an enlarged top view of the feed spool and braking device.
Figure 3:
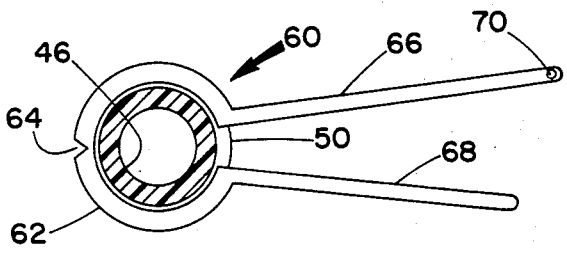
FIG. 3 is a bottom view of the feed spool and braking device of FIG. 2.

One braking assembly of the present invention includes a braking device, generally indicated as 60, referring particularly to FIGS. 2 to 4, comprised of a segmented ring-shaped base member 62 including an excised notch 64 and outwardly extending front and rear leg portions 66 and 68. The segmented ring-shaped base member 62 is formed on a side of the braking device 60 opposite the extended legs portions 66 and 68 thereof. The front leg portion 66 is formed with an upright pin member 70 perpendicularly-disposed to the leg portion 66 of the braking device 60 for engaging the ribbon 26, as more fully hereinafter discussed.

The braking device 60 is disposed in the groove 50 of the shaft member 42 of the ribbon supply spool 24 and is positioned within the base member 12 of the ribbon cassette 10 whereby a distal portion of the rear leg portion 68 is fixedly positioned therein between the leg member 30 and the base member 12. The ribbon 26 is coursed from the ribbon supply spool 24 around the upright pin portion 70 of the braking device 60 and thence to the take-up spool 28 via the ribbon exit 36 and the ribbon entry arm 38. The ribbon supply spool 24 including the braking device 60 is thus positioned within the ribbon cassette 10 in a pretensioned manner such that a braking effect is exerted on the free removal of ribbon 26 from the ribbon supply spool 24. Accordingly, the ribbon 26 is retained on the pin member 70 and does not move from the ribbon supply spool 24 during sudden movement of the ink ribbon 26. If the braking device was formed of metal, slippage might occur.

Upon rotation of ribbon take-up spool 28 by a ribbon drive assembly (not shown) of the particular serial printer, a tension is exerted on the ink ribbon 26 in the direction of the arrows 41 and thus on the pin member 70 to cause the leg portion 66 of the braking device 60 to move counterclockwise, thus opening up or spreading the leg portions 66 and 68 of the braking device 60 thereby decreasing the braking action as exerted on the shaft member 42 by the ring-shaped base portion 62 of the braking device 60 disposed in the groove 50 of the shaft member 42 and permitting the ribbon 26 to be freely withdrawn from the ribbon spool 24 in the direction indicated by the arrow 40.

Figure 5:
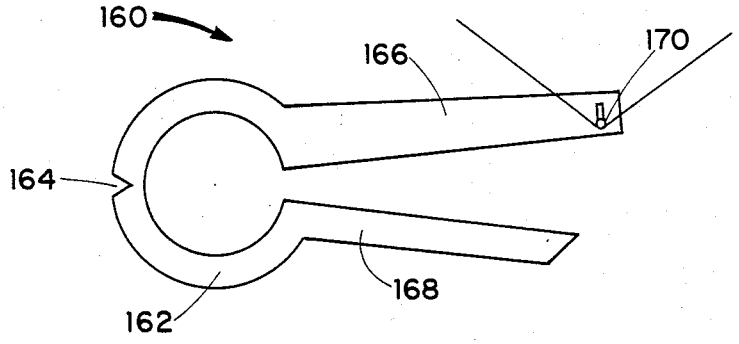
FIG. 5 is an enlarged top view of another braking device illustrating another embodiment of the present invention.

Referring now to FIG. 5, there is illustrated another braking device, generally indicated as 160, comprised of a segmented ring-shaped base member 162 including an excised notch 164 and with outwardly extending front and rear leg portions 166 and 168. The segmented ring-shaped base member 162 is formed on a side of the braking device 160 opposite the extended legs portions 166 and 168 thereof. The front leg portion 166 is of a greater width than the rear leg portion 168 and is formed with an upright pin member 170 perpendicularly-disposed to the leg portion 166 of the braking device 160.

Figure 6:
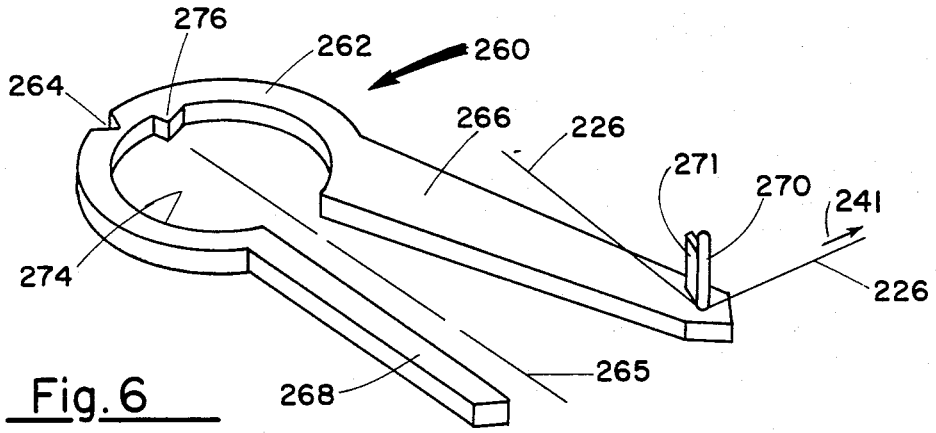
FIG. 6 is an enlarged isometric view of still another braking device illustrating another embodiment of the present invention.

FIG. 6 illustrates another breaking device, generally indicated as 260 comprised of a segmented ring-shaped base member 262 including an excised notch 264 and with outwardly extending front and rear leg portions 266 and 268. The segmented ring-shaped base member 262 is formed on a side of the braking device 260 opposite the extended legs portions 266 and 268. The front leg portion 266 is of a greater width than the rear leg portion 268 and is formed with an upright pin member 270 perpendicularly-disposed to the leg portion 266 of the braking device 160.

Generally the excised notch 264 is formed on an angle bisector 265 between the leg portion 266 and 268. The pin member 270 may be provided with a reinforcing wall 271. The ring-shaped base member 262 is formed with a cylindrically-shaped inner surface 274 including an inwardly extending tooth member 276 on a segmented half portion of the ring shaped member 262 extending between the excised notch 264 and the front leg portion 266.

Figure 7:
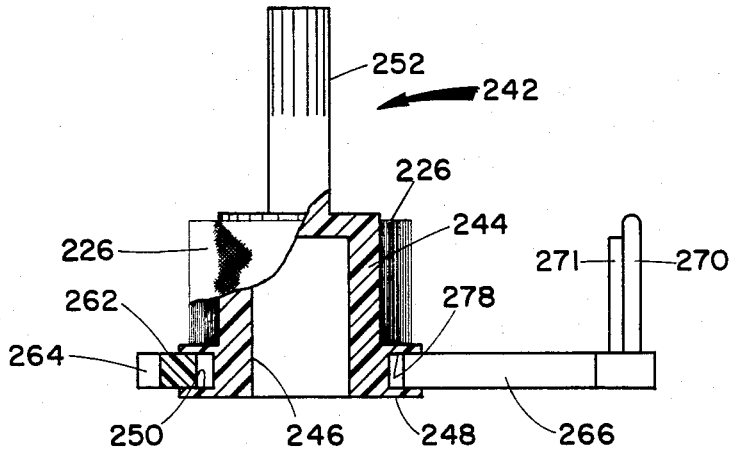
FIG. 7 is a partial cross-sectional side view of another feed spool of the present invention.

The braking device 260, referring to FIG. 7, is positioned on a shaft member gnerally indicated as 242 of a ribbon supply spool (not shown) including an inked ribbon 226. The shaft member 242 is comprised of a cylindrically-shaped base portion 244 including a cylindrically-shaped orifice 246, a lower ring shaped portion 248 formed with a rectangularly-shaped groove 250 including a serrated or inner geared surface 278, and a pin member 252. The lower ring-shaped portion 248 is of a diameter larger than the cylindrically-shaped base portion 244 on which is wound the ribbon 226. The pin member 252 includes an upper knurled section to aid in initial tensioning of a ribbon 266 within the ribbon cassette.

Similarly, to the operation of the braking assembly of FIGS. 1 to 4, upon rotation of ribbon take-up spool (not shown) by a ribbon drive assembly (not shown) of the particular serial printer, a tension is exerted on the ink ribbon 226 in the direction of arrow 241 and thus on the pin member 270 to cause the leg portion 266 to move counterclockwise, thus opening up or spreading the leg portion 266 and 268 of the braking device 260 whereby the tooth member 276 of the braking device 260 is disengaged from the serrated surface 278 of the shaft member 242 thereby to release the shaft member 242 from the ring-shaped base member 262 thereby permitting the ribbon 226 to be freely withdrawn from the ribbon supply spool (not shown).

Figure 8:
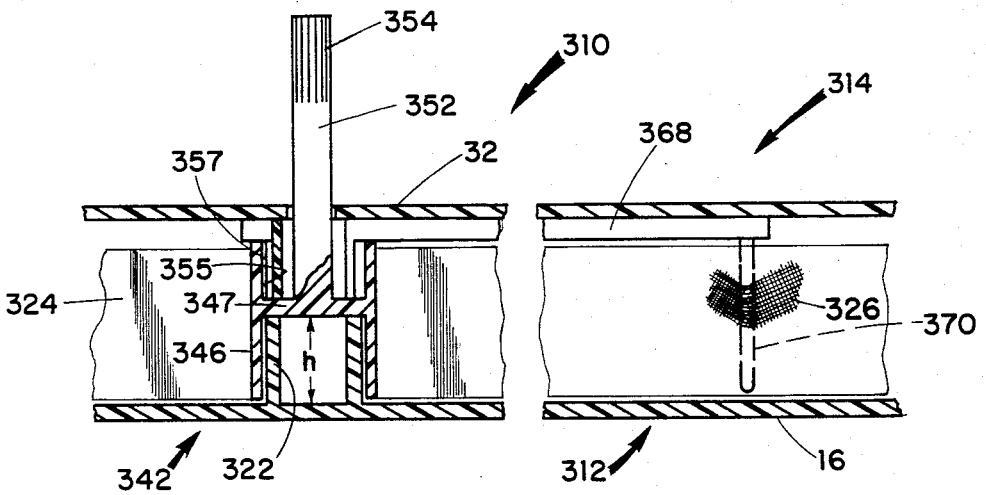
FIG. 8 is a partial cross-sectional side view of another ribbon cassettee assembly.
Figure 9:
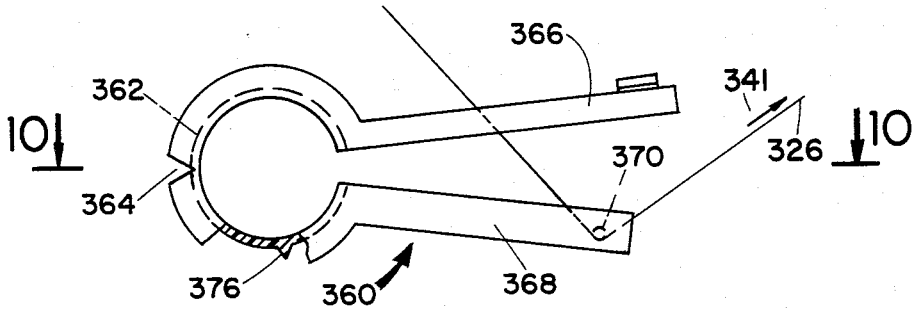
FIG. 9 is a top view of another braking device for the ribbon cassette assembly of FIG. 8.
Figure 10:
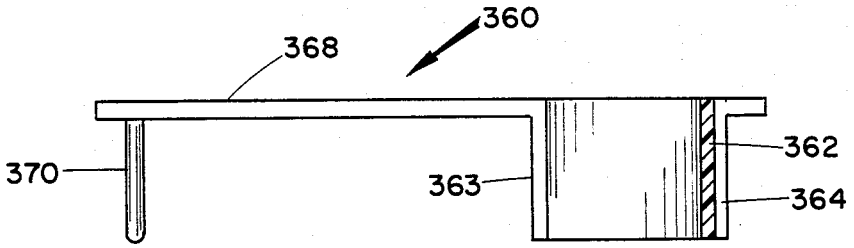
FIG. 10 is a side view, partially cutaway of the braking device of FIG. 9.

FIGS. 8 to 10 illustrate another embodiment of the present invention of a ribbon cassette assembly, generally indicated as 310 referring particularly to FIG. 8 comprised of a base member and a cover member, generally indicated as 312 and 314, respectively enclosing the ribbon cassette assembly 310, except for certain openings, as discussed with reference to the ribbon cassette assembly 10 of FIGS. 1 to 4. The base member 312 is formed with an upwardly extending shaft portion 322 of a height "h" for receiving a ribbon supply spool 324 including cylindrically-shaped shaft member, generally indicated as 342 having an inked ribbon 326 wound thereon.

The shaft member 342 is formed of a cylindrically-shaped base member 346 having an intermediate disc-shaped wall member 347 formed interiorally thereof including an upwardly extending pin member 352 housing an upper knurled surface portion 354. An inner cylindrical surface portion 355 of the base member 346 above the intermediate wall member 347 is formed with serrations 357. The wall member 347 is disposed on the shaft portion 322.

The braking device, referring particularly to FIGS. 9 and 10, generally indicated as 360, for the embodiment of FIGS. 8 to 10, is comprised of a segmented ring-shaped member 362 including a downwardly extending cylindrically-shaped base portion 363 and outwardly extending front and rear leg portions 366 and 368. A notch is formed in the ring-shaped 362 such notch extending the full length of the base portion 363. The segmented ring-shaped base member 362 is formed on a side of the braking device 360 opposite the extended legs portions 366 and 368 thereof. The rear leg portion 368 is formed with a downwardly extending pin member 370 perpendicularly-disposed to the leg portion 368 of the braking device 360 for engaging the ribbon 326, as more fully hereinafter discussed. The cylindrically shaped base portion 363 is formed with an outwardly extending tooth member 376 on an outer surface portion thereof on a segmented half portion extending between the notch 364 and the rear leg portion 368.

The braking device 360 is disposed within the upper portion of the shaft member 342 with a distal portion of the front leg portion 366 being fixedly positioned (not shown) to the cover member 14. The ribbon 326 is coursed from the ribbon supply spool 324 around the downwardly extending pin member 370 of the braking device 360 and thence to the take-up spool, etc. (not shown) similar to the embodiment of FIGS. 1 to 4. The shaft member 342, the inked ribbon 26 and the braking device 360 are thus positioned within the ribbon cassette (not shown) in a pretensioned manner such that a braking effect is exerted on the free removal of ribbon 326 from the ribbon supply spools 324 by engagement of the tooth 376 with the serration 357 formed on the inner surface of the shaft member 342. Accordingly, the ribbon 326 is retained on the pin member 370 and does not move from the ribbon supply spool 324 during sudden movement of the ink ribbon 326.

Similarly, to the operation of the braking assembly of FIGS. 1 to 4, upon rotation of ribbon take-up spool (not shown) by a ribbon drive assembly (not shown) of the particular serial printer, a tension is exerted on the ink ribbon 326 in the direction of arrow 341 and thus on the pin member 370 to cause the leg portion 368 to move counterclockwise, thereby causing the leg portion 366 and 368 of the braking device 360 to come together whereby the tooth member 376 of the braking device 360 is disengaged from the serrated surface 357 of the shaft member 342 thereby to release the shaft member 342 from the ring-shaped base member 362 thereby permitting the ribbon 326 to be freely withdrawn from the ribbon supply spool 324.

Although the present invention has been described with reference to a exemplary embodiments thereof, it will be appreciated by those skilled in the art that various modifications, alternatives, variations, etc., may be made without departing from the spirit and scope of the invention and that this invention be only limited by the appended claims and the equivalent thereof.

What is claimed:

1. A ribbon cassette assembly which comprises:

a cassette housing including a ribbon exit arm and a ribbon entry arm;

a ribbon supply spool positioned within said housing, said ribbon supply spool including a shaft member having a serrated surface;

a ribbon take-up spool positioned within said housing;

a ribbon coursed between said ribbon supply spool and said ribbon take-up spool via said ribbon exit arm and said ribbon entry arm; and a braking device comprised of a segmented ring-shaped portion having a first leg portion extending outwardly from one end thereof, and a second leg portion extending outwardly from another end thereof, one of said leg portions being fixedly positioned and said other leg portion including a pin member about which is coursed said ribbon, said segmented ring-shaped portion being positioned concentrically with respect to said shaft member, said segmented ring-shaped portion being formed of plastic material and having an outwardly extending radial notch disposed on an outer surface thereof opposite to said first and second leg portions; said ring-shaped portion having a tooth member extending from a cylindrical surface thereof at a position between said radial notch and said other leg portion including said pin member; sad tooth member engaging said serrated surface of said shaft member to brake said ribbon supply spool during the condition said ribbon take-up spool is inoperative, and said tooth member being disengaged from said serrated surface of said shaft member to release said ribbon supply spool during the condition said ribbon take-up spool is rotated.

2. The ribbon cassette assembly as defined in claim 1 wherein said cylindrical surface of said ring-shaped portion is an inner surface thereof; said tooth member extends inwardly; and said serrated surface is formed on an exterior surface of said shaft member.

3. The ribbon cassette assembly as defined in claim 1 wherein said cylindrical surface of said ring-shaped portion is an outer surface thereof and said tooth member extends outwardly; said shaft member includes a cylindrically-shaped base member having an inner surface including said serrated surface, said segmented ring-shaped portion being positioned partially within said cylindrically-shaped base member.

* * * * *

UNITED STATES PATENT AND TRADEMARK OFFICE

CERTIFICATE OF CORRECTION

PATENT NO. : 4,521,125

DATED : June 4, 1985

INVENTOR(S) : Klaus Turbon

It is certified that error appears in the above-identified patent and that said Letters Patent is hereby corrected as shown below:

Claim 1, line 27, delete "sad", and substitute -- said --.

Signed and Sealed this

First Day of October 1985

[SEAL]

*Attest:*

DONALD J. QUIGG

*Attesting Officer*

*Commissioner of Patents and Trademarks—Designate*